US005942335A

United States Patent [19]

Chen et al.

[11] Patent Number: 5,942,335

[45] **Date of Patent: *Aug. 24, 1999**

[54] INK JET RECORDING SHEET

[75] Inventors: Yung T. Chen, Lexington; Gerald P. Harwood, Jr., Billerica; Shawn P. Lambert, Marlborough; Kenneth J. McCarthy, Duxbury; Richard J. Murphy, Dennisport; Michael S. Viola, Burlington; Xiaojia Z. Wang, Acton, all of Mass.

[73] Assignee: Polaroid Corporation, Cambridge, Mass.

[ * ] Notice: This patent is subject to a terminal disclaimer.

[21] Appl. No.: 08/843,736

[22] Filed: Apr. 21, 1997

[51] Int. Cl.[6] ..... B41M 5/00

[52] U.S. Cl. ..... 428/500; 347/105; 428/195; 428/331; 428/520

[58] Field of Search ..... 428/195, 520, 428/331, 500; 347/105

[56] References Cited

U.S. PATENT DOCUMENTS

| | | | |
|---|---|---|---|
| 3,208,964 | 9/1965 | Valle | 260/29.6 |
| 3,507,846 | 4/1970 | Haas | 260/88.3 |
| 4,547,405 | 10/1985 | Bedell et al. | 427/256 |
| 4,575,465 | 3/1986 | Viola | 427/261 |
| 4,592,951 | 6/1986 | Viola | 428/323 |
| 4,592,954 | 6/1986 | Malhotra | 428/335 |
| 4,900,620 | 2/1990 | Tokita et al. | 428/330 |
| 4,904,519 | 2/1990 | Newman | 428/203 |
| 5,139,867 | 8/1992 | Light | 428/327 |
| 5,342,688 | 8/1994 | Kitchin et al. | 428/402 |

*Primary Examiner*—Bruce H. Hess
*Attorney, Agent, or Firm*—David J. Cole

[57] ABSTRACT

An ink jet recording sheet comprises a support carrying an ink-receiving layer, this layer comprising a hydrophilic polymer, preferably poly(vinyl alcohol) and a poly (vinylpyridine). The images formed using this sheet display good water fastness.

35 Claims, No Drawings

INK JET RECORDING SHEET

REFERENCE TO RELATED APPLICATIONS

Attention is directed to copending application Ser. No. 08/780,475, filed Jan. 7, 1997, which describes an ink jet recording sheet generally similar to that of the present invention but using a poly(vinylbenzyl quaternary ammonium salt) instead of a poly(vinylpyridine).

Attention is also directed to application Ser. No. 08/779,802, filed Jan. 7, 1997, entitled "Ink Jet Recording Sheet", assigned to the same assignee as the present application (now U.S. Pat. No. 5,856,023). This application describes and claims an ink jet recording sheet and method using a sheet having an ink receiving layer comprising a mixture of a non-derivatized poly(vinyl alcohol) and a derivatized poly(vinyl alcohol).

Attention is also directed to our copending application Ser. No. 08/743,817, of even date herewith, entitled "Process for the polymerization of 4-vinyl pyridine monomers", assigned to the same assignee as the present application. This application describes and claims the process for preparation of the preferred poly(4-vinylpyridine) for use in the present ink jet recording sheet.

The entire disclosures of the three aforementioned copending applications are herein incorporated by reference.

BACKGROUND OF THE INVENTION

This invention relates to an ink jet recording sheet which is intended to be printed by an ink jet printer.

Ink jet printers, that is to say printers which form an image by firing a plurality of discrete drops of ink from one or more nozzles on to the surface of a recording sheet placed adjacent the nozzles, have recently enjoyed a large increase in sales. Such ink jet printers have the advantage that they can reproduce good quality text and images, in both monochrome and full color, can produce both reflection prints and transparencies, and are relatively inexpensive to manufacture and to operate, as compared with, for example, color laser printers, thermal wax transfer printers and dye sublimation printers. Accordingly, ink jet printers now dominate the home/small office market, and are often also used in larger offices to provide color capability not available from the monochrome laser printers typically employed in such offices.

Although modern ink jet printers can print on almost any conventional paper or similar medium, and indeed are routinely used with commercial photocopying paper for printing text, the quality of images produced by such printers is greatly affected by the properties of the medium used. To produce high quality images reliably, it is necessary that the medium (ink jet recording sheet) used rapidly absorb the ink, in order that the ink does not remain wet for an extended period, since otherwise the ink is likely to smear when successive sheets are stacked in the output tray of the printer. On the other hand, the medium should not promote excessive spreading of the ink droplet, since such spreading reduces image resolution and may result in color distortion if adjacent ink droplets intermix. The medium also should not promote "wicking", that is to say spreading of ink by capillary action through fibrous media, such as paper. The medium must be capable of absorbing the ink without substantial distortion of the medium, since otherwise unsightly "cockling" (formation of ripples and similar folds) may occur, and most observers find such distortions unacceptable. Once the ink has dried, the medium should be such that contact of the image with moist surfaces (such as sweaty fingers), or storage of the images in damp locations, does not result in bleeding of ink from the image. Finally, since the surface characteristics, such as smoothness, glossiness and feel, of the image are largely determined by the same characteristics of the medium, the medium should possess characteristics appropriate to the type of image being printed. When, as is increasingly common, an ink jet printer is used to print a digital image produced by a camera or a scanner, the medium should be smooth and possess the high gloss and smooth feel of conventional silver-halide based photographic printing paper.

It is difficult to reconcile all these demands upon an ink jet printing medium and, as shown by the literature, much research has been dedicated to improving such media. For example, U.S. Pat. No. 4,592,951 describes an ink jet recording sheet comprising a transparent support carrying a layer of cross-linked poly(vinyl alcohol).

U.S. Pat. No. 4,904,519 describes an ink jet recording sheet comprising a transparent polymeric backing having on at least one major surface thereof a transparent, ink-receptive layer comprising a cross-linked, hydrolyzed copolymer of a vinyl ester comonomer selected from the group consisting of vinyl acetate, vinyl propionate and vinyl stearate, and a vinyl amide comonomer selected from the group consisting of N-vinyl pyrrolidone and vinyl acetamide, the degree of hydrolysis being from about 80 to 95%, and the cross-linking being effected by an agent selected from the group consisting of borates, titanates, dichromates and aldehydes.

U.S. Pat. No. 4,900,620 describes an ink jet recording sheet including a sheet-like substrate composed mainly of 70 to 100 wt % of wood pulp and 0 to 30 wt % of precipitated calcium carbonate and having a Stockigt sizing degree of not less than 2 seconds and not more than 25 seconds when formed into a sheet having a basis weight of 64 g/m$^2$, and a coating layer composed mainly of white pigment, with the coating layer being formed on at least one side of the substrate at a weight of 1 to 10 g/m$^2$. According to this patent, this sheet has a high ink absorption rate and is able to develop bright colors and sharp images.

U.S. Pat. No. 5,139,867 describes transparent image-recording elements that contain ink-receptive layers that can be imaged by the application of liquid ink dots. The ink-receptive layers contain a combination of:

(i) a vinyl pyrrolidone;

(ii) particles of a polyester, namely a poly (cyclohexylenedimethylene-co-oxydiethylene isophthalate-co-sodio-sulfobenzenedicarboxylate);

(iii) a homopolymer or a copolymer of an alkylene oxide containing from 2 to 6 carbon atoms;

(iv) a polyvinyl alcohol;

(v) a compound or a mixture of compounds having the general formula $$R_2O(CHR_1CH_2O)_nR_3$$

wherein $R_1$ represents a hydrogen atom or a methyl group, $R_2$ and $R_3$ each represent a hydrogen atom, an alkyl group having a carbon number of 1 to 4 or a phenyl group, and n is an integer of 1 to 10; and (vi) inert particles.

U.S. Pat. No. 4,592,954 describes a transparency for ink jet printing comprised of a supporting substrate and thereover a coating consisting essentially of a blend of carboxymethyl cellulose, and polyethylene oxides. Also disclosed are papers for use in ink jet printing comprised of a plain paper substrate and a coating thereover consisting essentially of polyethylene oxides.

U.S. Pat. No. 5,342,688 describes an ink-receptive sheet comprising a transparent substrate bearing on at least major surface thereof an ink-receptive layer which comprises at least one imaging polymer and an effective amount of polymeric mordant, which comprises a polymethylene backbone carrying pendant aminoguanidino groups.

U.S. Pat. No. 4,547,405 describes an ink jet recording sheet comprising a transparent support carrying a layer comprising a mixture of a coalesced block copolymer latex of poly(vinyl alcohol) with polyvinyl(benzyl ammonium chloride) and a water-soluble polymer selected from the group consisting of poly(vinyl alcohol), poly (vinylpyrrolidone) and copolymers thereof.

U.S. Pat. No. 4,575,465 describes an ink jet recording sheet comprising a transparent support carrying a layer formed from a mixture of vinylpyridine/vinylbenzyl quaternary ammonium salt copolymer and a hydrophilic polymer selected from the group consisting of gelatin, poly(vinyl alcohol), and hydroxypropyl cellulose, and mixtures thereof.

The present invention relates to ink jet recording sheets having ink-receiving layers generally similar to those described in U.S. Pat. No. 4,575,465 but comprising a poly(vinylpyridine). These ink jet recording sheets display improved imaging properties; in particular, the water fastness of the images produced on these sheets is substantially improved.

SUMMARY OF THE INVENTION

Accordingly, this invention provides an ink jet recording sheet comprising a support carrying an ink-receiving layer, this ink-receiving layer comprising a hydrophilic polymer and a poly(vinylpyridine).

This invention also provides a method of ink jet printing which comprises applying to an ink jet recording sheet a plurality of ink droplets generated from an ink jet printer, wherein the ink jet recording sheet comprises a support carrying an ink-receiving layer, this ink-receiving layer comprising a hydrophilic polymer and a poly (vinylpyridine).

In specific preferred ink jet recording sheets and methods of the present invention, the ink-receiving layer comprises:

(A)

from about 50 to about 80 parts by weight of poly(vinyl alcohol);

from about 5 to about 15 parts by weight of a poly (vinylpyridine):

from about 15 to about 30 parts by weight of poly(vinyl pyrrolidone);

from 0 to about 1 part by weight of a surfactant; or (B)

from about 10 to about 30 parts by weight of poly(vinyl alcohol);

from about 5 to about 15 parts by weight of a poly (4vinylpyridine);

from about 50 to about 80 parts by weight of poly(vinyl pyrrolidone);

from 0 to about 5 parts by weight of silica gel;

from about 0 to about 5 parts by weight of a cross-linking agent capable of cross-lining poly(vinyl alcohol); and from 0 to about 1 part by weight of a surfactant.

DETAILED DESCRIPTION OF THE INVENTION

As already mentioned, the ink jet recording sheet and method of the present invention use an ink-receiving layer comprising a hydrophilic polymer and a poly (vinylpyridine). The poly(vinylpyridine) is very desirably a poly(4-vinylpyridine). It has been found that the properties of the ink-receiving layer are significantly affected by the process used to prepare the poly(4-vinylpyridine); desirably, the hydrophilic polymer used with poly(4-vinylpyridine) is poly(vinyl alcohol) and the poly(4-vinylpyridine) is prepared by polymerizing 4-vinylpyridine in the presence of at least part of the poly(vinyl alcohol). Such a polymerization may be conducted by the processes described in U.S. Pat. Nos. 3,208,964 and 3,507,846, but poly(4-vinylpyridine) produced by these two processes tends to produce some non-uniformity in black areas of images produced from the recording sheet. It is believed (although the invention is in no way limited by this belief) that this non-uniformity is due to the suspension polymerization mechanism of the processes described in these two patents, which may tend to cause certain heterogeneities in the product.

It has now been found that the uniformity of black areas of images produced on the present recording sheet is improved by effecting the polymerization of the 4-vinylpyridine using a precipitation polymerization procedure in which substantially all of the initiator, and most if not all of the 4-vinylpyridine, are present in solution. Accordingly, in a preferred procedure, the poly(4-vinylpyridine) used in the present recording sheet, is prepared by preparing an aqueous dispersion of poly(vinyl alcohol) and contacting this aqueous solution with less than about 10 percent by weight (based upon the weight of the aqueous solution of 4-vinylpyridine monomer and a water-soluble free radical initiator. A preferred free radical initiator for use in this reaction is 2,2'-azobis(2-amidinopropane) hydrochloride, solid commercially by Wako Chemical, USA Inc., 1600 Bellwood Rd., Richmond, Va. 23237 under the Registered Trade Mark V50. By keeping the concentration of 4-vinylpyridine relatively low, the major part of this monomer is solubilized in the aqueous dispersion, allowing homogeneous initiation to occur and a more homogeneous product to be produced. This process has the further advantage that typically the residual monomer concentration in the product is greatly reduced, usually by about an order of magnitude, as compared with the products of the processes described in the two aforementioned patents.

As already noted, in this preferred polymerization process, at least part of the poly(vinyl alcohol) is present, and functions as an emulsifier and viscosity enhancer. It should be noted that in many cases it is not necessary to include in the polymerization reaction all of the poly(vinyl alcohol) which will eventually be admixed with the poly(4-vinylpyridine) in the ink-receiving layer. In particular, when the poly(4-vinylpyridine) in the ink-receiving layer is to comprise a mixture of a derivatized and an underivatized poly(vinyl alcohol), in accordance with the aforementioned copending application Ser. No. 08/779,802, it is often advantageous to include only the underivatized poly(vinyl alcohol) in the polymerization reaction and to add the derivatized poly(vinyl alcohol) later.

At the completion of the polymerization reaction, much of the poly(4-vinylpyridine) produced is in the form of a precipitate, and it is highly desirable to solubilize this polymer before the polymeric mixture is used to form the ink-receiving layer. To effect such solubilization, it is desirable to add an acid to the reaction product, a preferred acid for this purpose being lactic acid.

Although other hydrophilic polymers, for example gelatin or hydroxypropyl cellulose, may be used in the ink jet recording sheets of the present invention, as already mentioned the preferred hydrophilic polymer is poly(vinyl alcohol), since this polymer has been found to give ink-receiving layers with the best ink-receiving properties. The optimum weight ratio of poly(vinyl alcohol) to the poly(4-vinylpyridine) for any particular ink may be determined by skilled persons using routine empirical tests; however, for general guidance it may be stated that typically from about 3 to about 15 parts, desirably from about 5 to about 8 parts, by weight of the poly(vinyl alcohol) per part by weight of the poly(vinyl pyridine) produces optimum results.

As described in the aforementioned copending application Ser. No. 08/779,802, in some recording sheets of the present invention, it has been found advantageous to use a mixture of derivatized and underivatized poly(vinyl alcohol) in the present ink jet recording sheet, since it has been found that the mixture has better ink absorbing characteristics than either component alone, and that the presence of the derivatized poly(vinyl alcohol) improves ink drying time. Although the optimum mixture (which skilled persons can determine by routine empirical testing) will vary somewhat depending upon the particular derivatized and underivatized poly(vinyl alcohol)s used, in general it is preferred that the weight ratio of the non-derivatized poly(vinyl alcohol) to the derivatized poly(vinyl alcohol) in the ink-receiving layer be in the range of from about 2:1 to about 1:2; in some cases, uses of approximately equal weights of the two polymers gives the best results.

Derivatized poly(vinyl alcohol) differs from conventional (also, for convenience referred to herein as "underivatized") poly(vinyl alcohol) in that at least some of the hydroxyl groups present in the underivatized poly(vinyl alcohol) are replaced by ether or ester groupings, preferably the latter. A preferred type of derivatized poly(vinyl alcohol) for use in the present invention is an acetoacetylated poly(vinyl alcohol), in which the hydroxyl groups are esterified with acetoacetic acid. Acetoacetylated poly(vinyl alcohol) is available commercially, for example as Gohsefimer Z-200, sold by Nippon Gohsei, No. 9-6, Nozaki-cho, Kita-ku, Osaka, Japan. This material is stated by the manufacturer to be a super hydrolyzed poly(vinyl alcohol) having a degree of hydrolysis of 99–100%, a viscosity in 4% aqueous solution at 20° C. of 13.3–14.3 cps and a pH in the same solution of 3.5–5.

A preferred underivatized poly(vinyl alcohol) for use in the present ink jet recording sheet is Airvol 205 ("Airvol" is a Registered Trade Mark), sold by Air Products, Allentown, Pa. This material is stated by the manufacturer to be a partially hydrolyzed poly(vinyl alcohol) having a degree of hydrolysis of 87–89%, a viscosity in 4% aqueous solution at 20° C. of 5.2–6.2 cps and a pH in the same solution of 4.5–6.5. Airvol 350 from the same manufacturer has also given good results in the present recording sheet.

To produce an ink-receiving layer of optimum toughness and control of ink spreading, it is desirable that the poly (vinyl alcohol) be cross-linked. However, when the poly (vinylpyridine) is poly(4-vinylpyridine), it is advantageous to cross-link the poly(4-vinylpyridine) and the poly(vinyl alcohol), and a preferred type of cross-linking agent for this purpose is a diepoxy cross-linking agent; one preferred cross-linking agent of this type is 1,4-butanediol diglycidyl ether. Although such diepoxy cross-linking agents actually perform better under basic conditions, in practice in the present invention it may be desirable to include an acid, for example acetic acid or lactic acid, to solubilize the poly(4-vinylpyridine) in the composition used to form the ink-receiving layer, and diepoxy cross-linking agents can still provide a satisfactory degree of cross-linking in the presence of such an acid.

The ink-receiving layer of the present recording sheet may contain other mordanting polymers in addition to poly(vinyl pyridine). In particular, the ink-receiving layer may comprise a poly(vinylbenzyl quaternary ammonium salt) of the formula:

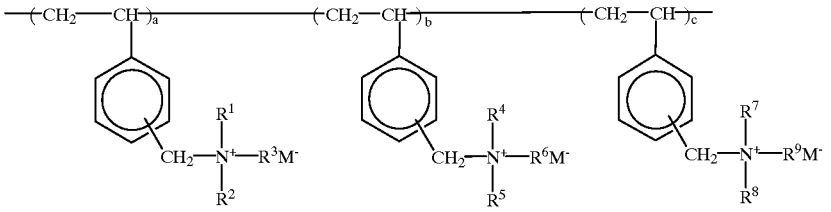

(wherein each of $R^1$, $R^2$, $R^3$, $R^4$, $R^5$ and $R^6$ is independently alkyl of from 1 to 4 carbon atoms; each of $R^7$, $R^8$ and $R^9$ is independently alkyl of from 1 to 18 carbon atoms and the total number of carbon atoms in $R^7$, $R^8$ and $R^9$ is from 13 to 20; each $M^-$ is an anion; and each of a, b and c is the molar proportion of the respective repeating units), as described in the aforementioned copending application Ser. No. 08/780,475.

In addition to poly(vinyl alcohol), the hydrophilic polymer used in the ink-receiving layer advantageously comprises poly(vinyl pyrrolidone); this polymer acts to control ink reception by the ink-receiving layer and to control dot spread, i.e., the tendency for the ink droplets to spread laterally across the sheet. This polymer also improves the gloss of the sheet, producing a sheet with an appearance closely resembling that of conventional silver-halide based photographic printing paper. It is also advantageous to include starch granules in the ink-receiving layer in order that the feel of the sheet will closely resemble that of photographic printing paper. Also, it has been found that including a surfactant in the ink-receiving layer further improves the ability of the layer to control dot spread; linear alkoxylated fatty alcohol surfactants, such as that sold commercially by BASF, Parsippany, N.J., under the trade name Plurafac C17, are preferred for this purpose. At least in some embodiments of the present invention, it is also desirable to include a minor proportion of silica gel in the ink-receiving layer; this material increases the smudge resistance of the image and also facilitates sheet handling during printing.

In preparing an ink jet recording sheet, it is necessary to consider not only the ink-receiving properties of the sheet, but also its mechanical properties. Most ink jet printers intended for home or small office use have an input tray for recording sheets at the front of the printer. Sheets withdrawn from this tray are carried 180° around a roller or roller assembly and thence across a platen, above which one or more ink jet heads reciprocate to effect printing. The sheets are carried from the platen to an output tray positioned vertically above the input tray; typically, movable support members are provided on the output tray to hold a sheet emerging from the platen above the output tray for a few seconds, in order to prevent the sheet still "wet" from printing coming into contact with the preceding sheet and thus avoid smearing of the image on either sheet. Because of space constraints in the printer, the roller or roller assembly is usually only about 4 cm in diameter, and the recording sheet must be able to be wrapped around that small diameter without acquiring a permanent "set", so that the sheet will lie flat on the platen and in the output tray. In some embodiments of the present invention, it has been found advantageous to include a minor proportion of a poly(alkyl acrylate) or a poly(alkyl methacrylate) in the ink-receiving layer to improve the sheet feeding properties of the medium, poly (methyl methacrylate) being especially preferred for this purpose.

The proportions of the various components in the ink receiving layer may vary over a considerable range, but persons skilled in the art of preparing ink jet recording media will be able to determine the optimum proportions for any specific formulation by routine empirical tests. As already indicated, by way of general guidance, it may be stated that in one form of the present invention, the ink-receiving layer may typically comprise:

- from about 50 to about 80 parts by weight of poly(vinyl alcohol);
- from about 5 to about 15 parts by weight of poly(4-vinylpyridine);
- from about 15 to about 30 parts by weight of poly (vinylpyrrolidone); and
- from 0 to about 1 (most desirably about 0.2) part by weight of a surfactant.

If the layer contains starch, the starch will typically be in an amount of from about 2 to about 8 parts by weight. Similarly, if the layer contains silica gel, this will typically be present in an amount of from about 1 to about 4 parts by weight, and if a cross-linking agent is present, it will typically be present in an amount of less than about 3 percent by weight.

It will be appreciated that the optimum proportions of the various components in the ink-receiving layer of the present recording sheet may vary depending upon the chemical composition of the ink with which it is intended to be used, since such factors as ink spread, glossiness etc. are greatly affected by chemical interactions between the ink and the ink-receiving layer. Specifically, it has been found that, when the ink to be used for imaging contains a glycol ether cosolvent in addition to water, it is advantageous to increase significantly the proportion of poly(vinyl pyrrolidone) in the ink-receiving layer, up to as much as 80 percent of the layer, with consequent decreases in the proportion of the poly (vinyl alcohol) and the poly(vinyl pyridine). Accordingly, with such inks, the ink-receiving layer may comprises:

- from about 10 to about 30 parts by weight of poly(vinyl alcohol) (which may be all derivatized poly(vinyl alcohol));
- from about 5 to about 15 parts by weight of poly(4-vinylpyridine);
- from about 50 to about 80 parts by weight of poly(vinyl pyrrolidone);
- from 0 to about 5 parts by weight of silica gel;
- from 0 to about 5 parts by weight of a cross-linking agent capable of cross-linking poly(vinyl alcohol) and poly (4-vinylpyridine); and
- from 0 to about 1 part by weight of a surfactant.

In addition to the components discussed above, the ink-receiving layer may comprise various conventional additives, for example ultraviolet absorbers, antioxidants, humectants, bactericides, fungicides and cross-linking agents.

The support employed in the present invention is not critical, and will normally be chosen having regard to the type of image which is intended to be produced, the proposed use of the image and the specific ink employed. The support may be transparent or opaque, depending upon whether a transparency or reflection print is desired. Polymeric films of both synthetic and naturally occurring polymeric materials may be employed. Examples of suitable transparent polymeric materials include polymethacrylic acid; methyl and ethyl esters; polyamides, such as nylons; polyesters, such as the polymeric films derived from ethylene glycol terephthalate acid; polymeric cellulose derivatives; polycarbonates; polystyrene and the like. Non-transparent supports include paper and synthetic papers such as silica-based synthetic papers. To promote adhesion of the ink-receiving layer to the support, subcoats or surface treatments of the support, such as corona discharge, may be employed.

The ink jet recording sheet of the present invention is primarily intended for use with aqueous and alcohol based inks (which as already noted, may contain organic cosolvents such as glycol ethers), although we do not exclude the possibility that the sheet may be useful in conjunction with inks based upon hydrophobic organic solvents such as hydrocarbons.

The ink jet recording sheet of the present invention can be prepared by conventional coating techniques. As illustrated in Example 3 below, typically the various components of the ink-receiving layer will be prepared in the form of an aqueous solution or dispersion, coated on to the desired support and dried to produce the final recording sheet.

The following Examples are now given, though by way of illustration only, to show particularly preferred reagents, conditions and techniques used in preparing the ink jet recording sheet of the present invention.

EXAMPLE 1

This Example illustrate a preferred process for the preparation of a mixed poly(vinyl alcohol)/poly(4-vinylpyridine) solution for use in the present recording medium and process.

310.6 kg of polyvinyl alcohol (Airvol 350, fully hydrolyzed) was solubilized in 5466 L of deaerated, deionized water at about 95° C. under nitrogen for about forty-five (45) minutes, and then, cooled to about 65° C.

163.2 kg of 4-vinylpyridine monomer (Reilly Industries, Inc, 300 North Meridian Street, Suite 1600, Indianapolis, Ind. 46204) and 75.6 L of deaerated, deionized water were added to the polyvinyl alcohol solution at about 65° C. and stirred for about forty-five (45) minutes.

Next, 4.4 kg of water-soluble initiator (V50) in 37.8 L of deaerated, deionized water was added to the solution containing the poly(vinyl alcohol) and the 4-vinylpyridine monomer to initiate polymerization, which was allowed to proceed for about three (3) hours at about 65° C.

The weight average molecular weight of the poly(4-vinylpyridine) produced by the above polymerization process, determined by gel permeation chromatography (poly-2-vinylpyridine standard), is about 250,000.

The residual 4-vinylpyridine monomer concentration, determined by gas chromatography (10% polyethyleneglycol, 2% potassium hydroxide, glass column, ¼ inch by 12 foot), is 97 parts per million (ppm).

To prepare the resultant fluid produced by the above process for use in coating an ink-receiving recording layer, the fluid was heated to about 90° C. for thirty (30) minutes to destroy any remaining V50. After cooling the resultant fluid to about 60° C., 72.8 kg of 88% aqueous lactic acid and 1243 L of deionized water were added with stirring for thirty (30) minutes while maintaining the solution at about 60° C. to solubilize the poly(4-vinylpyridine), and then, cooled to room temperature.

As will be appreciated from the data reported in this Example, no appreciable residual 4-vinylpyridine monomer remains in the resultant fluid of the polymerization process, i.e., less than 0.01% by weight, which is generally about a 10-fold reduction in resultant vinyl pyridine monomer when compared to the data reported in aforementioned U.S. Pat. No. 3,507,846. It is thought that this reduction is due to a more homogeneous initiation derivable from the water solubility of the water-soluble initiator, and the amount of 4-vinyl pyridine monomer selected in the polymerization process of the present invention.

EXAMPLE 2

This Example illustrate a second preferred process for the preparation of a mixed poly(vinyl alcohol)/poly(4-vinylpyridine) solution for use in the present recording medium and process.

2.6 kg of poly(vinyl alcohol) (Airvol 540, partially hydrolyzed) was solubilized in 41 kg of deaerated, deionized water at about 95° C. under nitrogen.

1.37 kg of 4-vinylpyridine monomer (Reilly Industries, Inc.) was added to the polyvinyl alcohol solution, and the temperature was increased to 65° C.

Next, 44 g of water-soluble initiator (V50) in 730 g of deaerated, deionized water was added to the solution containing the poly(vinyl alcohol) and the 4-vinylpyridine monomer to initiate polymerization, which was allowed to proceed for about three (3) hours at about 65° C.

The weight average molecular weight of the poly(4-vinylpyridine) produced by the above polymerization process, determined by gel permeation chromatography (poly-2-vinylpyridine standard), is about 215,000.

The residual 4-vinylpyridine monomer concentration, determined by gas chromatography in the same way as in Example 1 above is 42 ppm.

To prepare the resultant fluid produced by the above process for use in coating an ink-receiving recording layer, the fluid was heated to about 90° C. for thirty (30) minutes to destroy any remaining V50. After cooling the resultant fluid to about 60° C., 565 g of 88% aqueous actic acid and 1 kg of deionized water were added with stirring for thirty (30) minutes while maintaining the solution at about 60° C. to solubilize the poly(4-vinylpyridine), and then, cooled to room temperature.

As will be appreciated from the data reported in this Example, no appreciable residual 4-vinyl pyridine monomer remains in the resultant fluid of the polymerization process, i.e., less than 0.01% by weight.

EXAMPLE 3

A dispersion was formed from the following components; all parts by weight are quoted on a dry solids basis:

| | Parts by weight |
|---|---|
| Underivatized poly(vinyl alcohol) (Airvol 350) | 20.0* |
| Poly(4-vinylpyridine) | 10.0* |
| Acetoacetylated poly(vinyl alcohol) (Z200) | 39.0 |
| Poly(vinyl pyrrolidone) | 27.5 |
| Silica gel | 2.0 |
| Diepoxy cross-linking agent | 0.3 |
| Acetic acid | 1.0 |
| Surfactant (Plurafac C17) | 0.2 |

The mixed poly(vinyl alcohol)/poly(4-vinylpyridine) solution, and an aqueous solution of Z200, were added to water, and mixed in a air-driven mixer for 30 minutes. The surfactant, silica gel and poly(vinyl pyrrolidone) were then added, and the resultant mixture mixed for a further 30 minutes to produce a dispersion suitable for coating.

The dispersion thus produced was coated on to a 7.6 mil polyclad photo paper using a No. 24 Mayer rod coater at a coating weight of 4.2 g/ml$^2$, and the coated sheets were dried in a 80° C. oven for 10 minutes. The dried ink jet recording sheets were tested using a Hewlett Packard Deskjet 693C printer and were found to give excellent color images with minimal ink spread and smearing. Also, the printed sheets had a gloss and feel closely resembling that of conventional silver-halide based photographic printing paper. To test waterfastness, cyan, magenta and yellow printed images were placed into a beaker of deionized water for three minutes, taken out, shaken for 10 seconds and put back into water for another two minutes. After the washed samples dried, color densities of cyan, magenta, and yellow were recorded using an X-Rite 310 photographic densitometer, supplied by X-Rite, Inc., Grandville, Mich., equipped with the appropriate filter. The optical densities of the dry images before and after the immersion were as follows:

| | Cyan O. D. | Magenta O. D. | Yellow O. D. |
|---|---|---|---|
| Before immersion | 1.64 | 2.10 | 1.84 |
| After immersion | 1.52 | 2.09 | 1.08 |

These data indicate good waterfastness of the ink in the ink-receiving layer.

We claim:

1. An ink jet recording sheet comprising a support carrying an ink-receiving layer, this ink-receiving layer comprising a hydrophilic polymer, a poly(vinylpyridine) and poly (vinylpyrrolidone).

2. An ink jet recording sheet according to claim 1 wherein the poly(vinylpyridine) is a poly(4-vinylpyridine).

3. An ink jet recording sheet according to claim 2 wherein the hydrophilic polymer is poly(vinyl alcohol) and the poly(4-vinylpyridine) has been prepared by polymerizing 4-vinylpyridine in the presence of at least part of the poly(vinyl alcohol).

4. An ink jet recording sheet according to claim 3 wherein the poly(4-vinylpyridine) has been prepared by preparing an aqueous dispersion of poly(vinyl alcohol) and contacting this aqueous solution with less than about 10 percent by weight (based upon the weight of the aqueous solution of 4-vinylpyridine monomer and a water-soluble free radical initiator.

5. An ink jet recording sheet according to claim 4 wherein the free radical initiator comprises 2,2'-azobis(2-amidinopropane) hydrochloride.

6. An ink jet recording sheet according to claim 1 wherein the hydrophilic polymer is poly(vinyl alcohol).

7. An ink jet recording sheet according to claim 6 wherein the ink-receiving layer comprises from about 3 to about 15 parts by weight of the poly(vinyl alcohol) per part by weight of the poly(vinylpyridine).

8. An ink jet recording sheet according to claim 7 wherein the ink-receiving layer comprises from about 5 to about 8 parts by weight of the poly(vinyl alcohol) per part by weight of the poly(vinylpyridine).

9. An ink jet recording sheet according to claim 6 wherein the poly(vinylpyridine) is a poly(4-vinylpyridine) and the poly(vinyl alcohol) and the poly(4-vinylpyridine) are cross-linked.

10. An ink jet recording sheet according to claim 9 wherein the poly(vinyl alcohol) and the poly(4-vinylpyridine) are cross-linked with a diepoxy cross-linking agent.

11. An ink jet recording sheet according to claim 1 wherein the ink-receiving layer further comprises silica gel.

12. An ink jet recording sheet according to claim 1 wherein the ink-receiving layer further comprises a surfactant.

13. An ink jet recording sheet according to claim 12 wherein the surfactant is a linear alkoxylated fatty alcohol surfactant.

14. An ink jet recording sheet comprising a support carrying an ink-receiving layer, this ink-receiving layer comprising a poly(vinylpyridine) a non-derivatized poly (vinyl alcohol) and a derivatized poly(vinyl alcohol), in which at least some of the hydroxyl groups present in underivatized poly(vinyl alcohol) are replaced by ether or ester groupings, the weight ratio of the non-derivatized poly(vinyl alcohol) to the derivatized poly(vinyl alcohol) being in the range of from about 2:1 to about 1:2.

15. An ink jet recording sheet according to claim 14 wherein the derivatized poly(vinyl alcohol) is an acetoacetylated poly(vinyl alcohol).

16. A method of ink jet printing which comprises applying to an ink jet recording sheet a plurality of ink droplets generated from an ink jet printer, wherein the ink jet recording sheet comprises a support carrying an ink-receiving layer, this ink-receiving layer comprising a hydrophilic polymer and a poly(vinylpyridine).

17. A method according to claim 16 wherein the poly (vinyl pyridine) is a poly(4-vinylpyridine).

18. A method according to claim 17 wherein the hydrophilic polymer is poly(vinyl alcohol) and the poly(4-vinylpyridine) has been prepared by polymerizing 4-vinylpyridine in the presence of at least part of the poly(vinyl alcohol).

19. A method according to claim 18 wherein the poly(4-vinylpyridine) has been prepared by preparing an aqueous dispersion of poly(vinyl alcohol) and contacting this aqueous solution with less than about 10 percent by weight (based upon the weight of the aqueous solution of 4-vinylpyridine monomer and a water-soluble free radical initiator.

20. A method according to claim 19 wherein the free radical initiator comprises 2,2'-azobis(2-amidinopropane) hydrochloride.

21. A method according to claim 16 wherein the hydrophilic polymer is poly(vinyl alcohol).

22. A method according to claim 21 wherein the ink-receiving layer comprises from about 3 to about 15 parts by weight of the poly(vinyl alcohol) per part by weight of the poly(vinylpyridine).

23. A method according to claim 22 wherein the ink-receiving layer comprises from about 5 to about 8 parts by weight of the poly(vinyl alcohol) per part by weight of the poly(vinylpyridine).

24. A method according to claim 21 wherein the poly (vinylpyridine) is a poly(4-vinylpyridine) and the poly(vinyl alcohol) and the poly(4-vinylpyridine) are cross-linked.

25. A method according to claim 24 wherein the poly (vinyl alcohol) and the poly(4-vinylpyridine) are cross-linked with a diepoxy cross-linking agent.

26. A method according to claim 16 wherein the ink-receiving layer further comprises poly(vinylpyrrolidone).

27. A method according to claim 16 wherein the ink-receiving layer further comprises silica gel.

28. A method according to claim 16 wherein the ink-receiving layer further comprises a surfactant.

29. A method according to claim 28 wherein the surfactant is a linear alkoxylated fatty alcohol surfactant.

30. A method of ink jet printing which comprises applying to an ink recording sheet a plurality of ink droplets generated from an ink jet printer, wherein the ink jet recording sheet comprises a support carrying an ink-receiving layer, this ink-receiving layer comprising a poly(vinylpyridine), a non-derivatized poly(vinyl alcohol) and a derivatized poly(vinyl alcohol), in which at least some of the hydroxyl groups present in underivatized poly(vinyl alcohol) are replaced by ether or ester groupings, the weight ratio of the non-derivatized poly(vinyl alcohol) to the derivatized poly(vinyl alcohol) being in the range of from about 2:1 to about 1:2.

31. A method according to claim 30 wherein the derivatized poly(vinyl alcohol) is an acetoacetylated poly(vinyl alcohol).

32. An ink jet recording sheet comprising a support carrying an ink-receiving layer, this ink-receiving layer comprising:

from about 50 to about 80 parts by weight of poly(vinyl alcohol);

from about 5 to about 15 parts by weight of a poly(4-vinylpyridine);

from about 15 to about 30 parts by weight of poly (vinylpyrrolidone); and from 0 to about 1 part by weight of a surfactant.

33. A method of ink jet printing which comprises applying to an ink jet recording sheet a plurality of ink droplets generated from an ink jet printer, wherein the ink jet recording sheet comprises a support carrying an ink-receiving layer, this ink-receiving layer comprising:

from about 50 to about 80 parts by weight of polyvinyl alcohol);

from about 5 to about 15 parts by weight of a poly(4-vinylpyridine);

from about 15 to about 30 parts by weight of poly (vinylpyrrolidone); and from 0 to about 1 part by weight of a surfactant.

34. An ink jet recording sheet comprising a support carrying an ink-receiving layer, this ink-receiving layer comprising:

from about 10 to about 30 parts by weight of poly(vinyl alcohol);

from about 5 to about 15 parts by weight of a poly(4-vinylpyridine);

from about 50 to about 80 parts by weight of poly (vinylpyrrolidone);

from 0 to about 5 parts by weight of silica gel;

from 0 to about 5 parts by weight of a cross-linking agent capable of cross-lining poly(vinyl alcohol); and from 0 to about 1 part by weight of a surfactant.

35. A method of ink jet printing which comprises applying to an ink jet recording sheet a plurality of ink droplets generated from an ink jet printer, wherein the ink jet recording sheet comprises a support carrying an ink-receiving layer, this ink-receiving layer comprising:

from about 10 to about 30 parts by weight of poly(vinyl alcohol);

from about 5 to about 15 parts by weight of a poly(4-vinylpyridine);

from about 50 to about 80 parts by weight of poly (vinylpyrrolidone);

from 0 to about 5 parts by weight of silica gel;

from about 0 to about 5 parts by weight of a cross-linking agent capable of cross-lining poly(vinyl alcohol); and from 0 to about 1 part by weight of a surfactant.

* * * * *